US010995741B2

(12) United States Patent
Berndsen et al.

(10) Patent No.: US 10,995,741 B2
(45) Date of Patent: May 4, 2021

(54) PUMP HAVING A SUCTION SPACE SURROUNDED BY A DELIVERY SPACE

(71) Applicant: ALTOP PATENTS B.V., Montferland (NL)

(72) Inventors: Joost Robert Berndsen, Montferland (NL); Miechiel Anthony Berndsen, Montferland (NL)

(73) Assignee: ALTOP PATENTS B.V., Montferland (NL)

( * ) Notice: Subject to any disclaimer, the term of this patent is extended or adjusted under 35 U.S.C. 154(b) by 255 days.

(21) Appl. No.: 15/750,107

(22) PCT Filed: Aug. 1, 2016

(86) PCT No.: PCT/NL2016/050565
§ 371 (c)(1),
(2) Date: Feb. 2, 2018

(87) PCT Pub. No.: WO2017/023171
PCT Pub. Date: Feb. 9, 2017

(65) Prior Publication Data

US 2018/0223827 A1 Aug. 9, 2018

(30) Foreign Application Priority Data

Aug. 4, 2015 (NL) ..... 2015261

(51) Int. Cl.
*F04B 43/00* (2006.01)
*F04D 9/04* (2006.01)
(Continued)

(52) U.S. Cl.
CPC ..... *F04B 43/0054* (2013.01); *F04B 37/20* (2013.01); *F04D 9/043* (2013.01); *F04B 43/023* (2013.01); *F04B 43/028* (2013.01)

(58) Field of Classification Search
CPC .... F04B 43/028; F04B 43/023; F04B 53/104; F04B 23/026; F04B 37/20; F04B 43/0009;
(Continued)

(56) References Cited

U.S. PATENT DOCUMENTS 2,707,074 A * 4/1955 Tussey ..... F04B 45/047 417/566
3,578,880 A 5/1971 Cygnor
(Continued)

FOREIGN PATENT DOCUMENTS

DE 102007003466 A1 7/2008

OTHER PUBLICATIONS

International Search Report dated Oct. 25, 2016 for corresponding International Application, PCT/NL2016/050565, filed Aug. 1, 2016.
(Continued)

*Primary Examiner* — Bryan M Lettman
*Assistant Examiner* — Timothy P Solak
(74) *Attorney, Agent, or Firm* — Steven M. Koehler; Westman, Champlin & Koehler, P.A.

(57) ABSTRACT

A pump includes a suction space, a delivery space and valves. The suction space is at least partly bounded by a flexible body and located between end elements, at least one of which can be driven so as to move in a reciprocating manner. The delivery space surrounds the suction space and around which a housing is provided. The valves are provided in the housing and in at least one of the end elements, and are constructed such that when a volume of the suction space is increased, a medium is sucked into said suction space, and when the volume is reduced, the medium flows through one of the valves to the delivery space, from which it is expelled when the volume of the delivery space is reduced.

16 Claims, 1 Drawing Sheet

(51) Int. Cl.
*F04B 37/20* (2006.01)
*F04B 43/02* (2006.01)

(58) Field of Classification Search
CPC .. F04B 43/0045; F04B 53/125; F04B 53/129; F04B 43/0063; F04D 9/043
See application file for complete search history.

(56) References Cited

U.S. PATENT DOCUMENTS

| | | | | |
|---|---|---|---|---|
| 4,097,203 | A * | 6/1978 | Selwood | F04B 9/045 417/480 |
| 4,488,473 | A * | 12/1984 | Gammon | F04B 47/02 91/275 |
| 4,560,326 | A * | 12/1985 | Seki | F04B 43/028 417/274 |
| 4,565,497 | A * | 1/1986 | Miller | F04B 43/0063 417/63 |
| 6,409,478 | B1 * | 6/2002 | Carnes | F04D 9/043 417/200 |
| 6,616,427 | B2 | 9/2003 | Carnes et al. | |
| RE39,813 | E | 9/2007 | Carnes et al. | |
| 2002/0064468 | A1 * | 5/2002 | Wade | F04B 39/10 417/233 |
| 2002/0114707 | A1 | 8/2002 | Carnes et al. | |
| 2002/0168270 | A1 | 11/2002 | Carnes et al. | |

OTHER PUBLICATIONS

Written Opinion of the International Searching Authority dated Oct. 25, 2016 for corresponding International Application, PCT/NL2016/050565, filed Aug. 1, 2016.

* cited by examiner

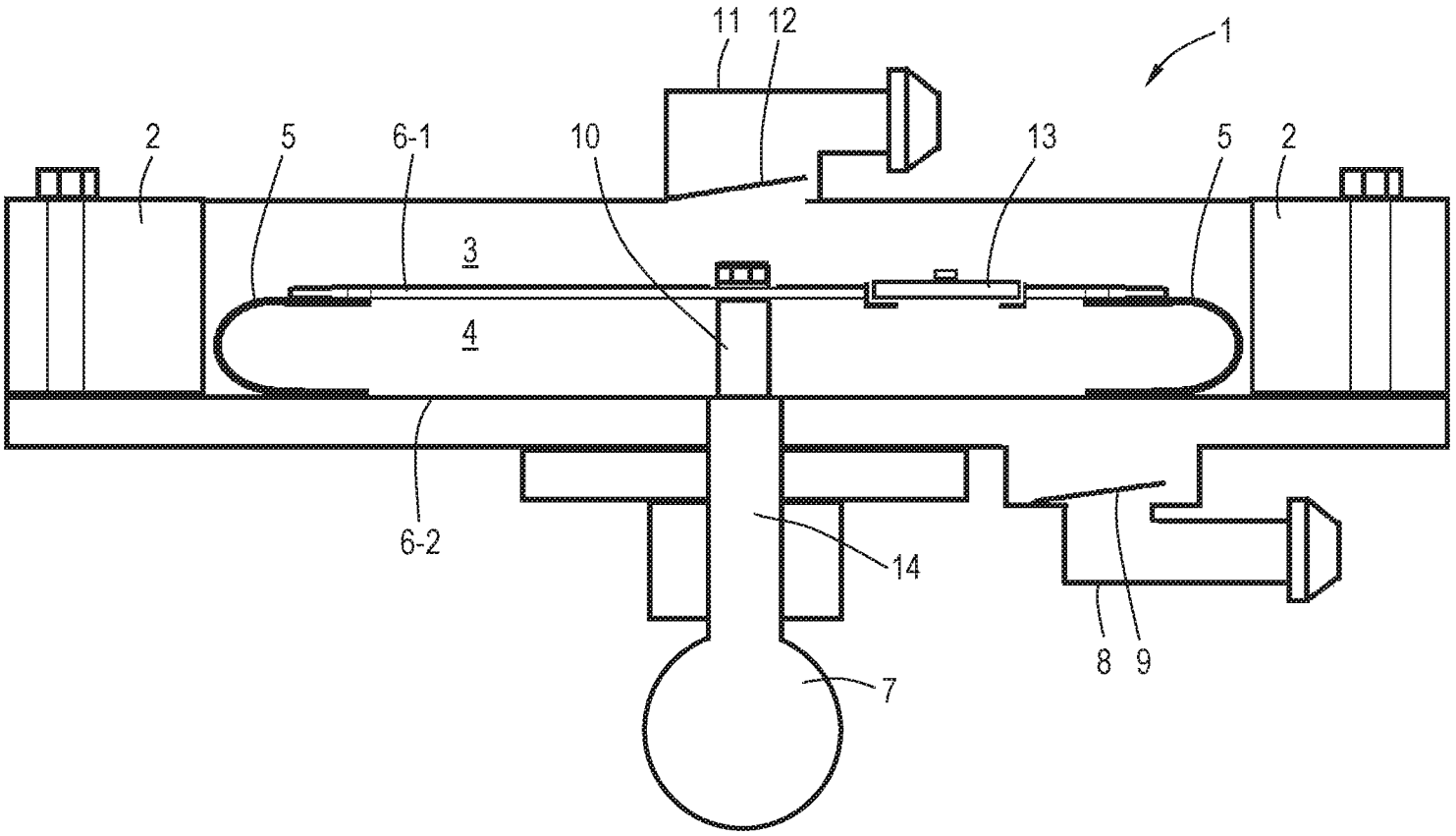
1
2
5
13
12
11
10
3
4
6-1
5
2
9
8
14
7
6-2

PUMP HAVING A SUCTION SPACE SURROUNDED BY A DELIVERY SPACE

CROSS-REFERENCE TO RELATED APPLICATION

This Application is a Section 371 National Stage Application of International Application No. PCT/NL2016/050565, filed and published as WO/2017/023171 on Feb. 9, 2017, in English.

BACKGROUND

The present invention relates to a pump. The present invention also relates to a method in which said pump serves as a double acting pump, and to the use of such a pump for transferring the medium.

A pump assembly in the form of a centrifugal pump which is self-starting by means of a vacuum pump comprising a float feature is disclosed in U.S. Pat. No. 6,616,427 B2. This assembly is configured such that a double acting pump is obtained comprising two mutually cooperating pumps, namely the centrifugal pump and the vacuum pump. The vacuum pump comprises a housing having a suction space which is bounded by a flexible, ring-shaped, flat diaphragm and which comprises oppositely located end plates, of which the upper plate can be moved in a reciprocating manner. The flexible, ring-shaped diaphragm, which is circumferentially fixed between the upper end plate and the two portions of the housing, and which is tensile loaded when movement occurs, divides the housing into two spaces of equal volume. On one side there is the suction space and on the other side of the upper end plate there is the delivery space. The lower end plate is provided with a valve, which is to be opened when there is a reduced pressure in the suction space, and through which valve air is drawn in from an air inlet, and the upper end plate is provided with a valve, which is to be opened by means of a tappet when there is an excess pressure in the suction space, and through which valve air is expelled at the next stroke to an air vent via a valve which is to opened when there is an excess pressure in the delivery space.

A drawback resides in that the displacement volume of the pump operating only as a vacuum pump is limited, and that said pump is vulnerable to water and/or water vapor in the medium drawn in, namely air. In addition, it has been found in practice that the reciprocating, flexible diaphragm will wear and tear relatively quickly, which adversely affects the service life.

SUMMARY

The present invention provides a universally applicable pump and method, which are not sensitive to water or water vapor, and which are capable of displacing large amounts of different media, such as a liquid but also air, and which pump in addition has both a long service life and a reduced sensitivity to wear.

To achieve this, the pump includes:

- a suction space which is at least partly bounded by a flexible body and which is located between end elements at least one of which can be driven so as to move in a reciprocating manner,
- a delivery space which surrounds the suction space and around which a housing is provided, and
- valves provided in the housing and in at least one of the end elements, the valves being constructed such that when the volume of the suction space is increased, a medium is sucked into said suction space, which, when the volume is reduced, flows through one of the valves to the delivery space from which it is expelled when the volume of the delivery space is reduced.

The corresponding method includes, inside a pump, by reciprocating a flexible body which is subjected to flexural strain thereby:

- during a first phase, the volume of a suction space which is at least partly bounded by the body is reduced, causing a medium contained therein to be forced, through a valve, into a delivery space which surrounds the suction space, after which
- during a second phase, when expansion of the suction space takes place, and when the valve closes, a reduced pressure is formed therein and, at the same time, an excess pressure is formed in the delivery space, causing the medium to be expelled.

An advantage of the pump and the method resides in that when the flexible body located between the end elements is moved up and down, said flexible body is exposed to bending loads, not tensile load. By virtue thereof, the service life of the pump is increased considerably and, in addition, larger volumes of various kinds of media can be pumped. The media to be pumped are not limited to gaseous media, since the gaseous media may also contain water or water vapor, but in addition also liquid media or gasses can be drawn in and transferred by the pump.

The housing of the pump accommodates the delivery space and the delivery space accommodates the suction space, as a result of which the flexible body makes a bending movement within the delivery space during the reciprocating movement. If required, for the valves to be applied in the pump use can advantageously be made of automatically operating valves, so that the valves are operated by means of excess pressure or reduced pressure in the medium to be pumped. By virtue thereof, features to open and close the valves, at the right points in time, can be dispensed with, as a result of which the pump is lighter in weight and the cost price can remain low, without the optimum operation being adversely affected. But by virtue thereof, pumps can additionally be connected in parallel in a simple manner, if this is required because a larger volume must be pumped, or pumps can be connected in series if the media must be transferred over larger distances.

A particularly cost price-friendly pump is characterized in that the flexible body is a bellows, or a belt, tyre, in particular an outer tyre.

Advantageously, the pump and the method can be universally used and applied in the process of pumping a medium or a mixture of mediums, which may or may not contain air, or in the process of pumping water or water vapor which may or may not contain air, or in the process of pumping air which may or may not contain water and/or water vapor.

Further detailed, possible embodiments, which are set forth in the remaining claims, are mentioned together with the associated advantages in the following description.

BRIEF DESCRIPTION OF THE DRAWING

The sole FIGURE is a schematic view of a pump.

DETAILED DESCRIPTION

The pump and the method according to the present invention will now be explained in greater detail with reference to the FIGURE mentioned below, in which a possible embodiment is shown, but by means of which also further possible embodiments as well as the principle on which the present invention is based will be explained.

The FIGURE shows a pump 1 comprising a housing 2 within which a delivery space 3 is located within which there is a suction space 4. The walls of the predominantly cylindrical suction space 4 are formed by a flexible body 5, which is connected to end elements 6-1, 6-2. In this case, the element 6-1 can be driven in a reciprocating manner by means of a mechanism 7, which will be elucidated hereinafter. If the end elements 6-1, 6-2 approach one another, the volume of the suction space is minimal, and the consequently inwardly bent body 5 is in a folded-up state, like a bellows, between said elements, and the volume of the delivery space 3 is maximal. Conversely, in the case that the end elements 6-1, 6-2 are the maximum distance apart, the consequently outwardly bent body 5 is in an unfolded state between said elements, and the volume of the suction space 4 is maximal, while that of the delivery space is minimal.

The pump 1 comprises an intake pipe 8 connected to the suction space 4, and a valve 9 arranged therebetween, which, in the case shown, opens automatically if a medium is drawn from the intake pipe 8 through the valve 9. An end element in the form of an end plate 6-1 is shown, which moves in a reciprocating manner under the influence of a movable rod 10 which is connected to said end plate and which is part of the mechanism 7 of the pump 1. In the embodiment shown, the end plate 6-2 forms part of the fixed lower side of the housing 2.

The pump 1 further comprises an outlet pipe 11 connected to the delivery space 3 through a valve 12. In the end plate 6-1, there is provided a valve 13 which closes automatically during the abovementioned medium-drawing process. If the direction of movement of the rod 10 reverses, causing the valve 9 to close automatically and likewise the valve 13 to open automatically due to the medium pressure in the suction space 4, the medium flows, during this transition phase, from the suction space 4 to the delivery space 3 until the minimum volume of the suction space 4 is reached. If the direction of movement of the rod reverses again, and hence the space 4 expands, the valve 13 closes automatically and, during this delivery phase, the medium is forced towards the outlet pipe 11 through the valve 12 which is in the process of opening. Also, during this delivery phase, the suction space 4 is filled again with medium drawn through the open valve 9. The method explained hereinabove continues.

The flexible body 5, which, as shown in the FIGURE, is completely located inside the delivery space, may be a bellows known per se, but also a belt, or a tyre. The two plates 6-1, 6-2, which are generally substantially flat in practice, with which the respective edges of the tyres are connected are similar to the rim of a wheel, however, as explained hereinbefore, the plates 6 are constructed so as to be movable with respect to one another. Advantageously, use can even be made of worn tyres 5 costing near to nothing or nothing at all.

The movable end plate 6-1 shown in the FIGURE is connected, as explained hereinbefore, to a rod 10 which can move in a reciprocating manner and which is connected, via a bushing 14 in the other end plate 6-2, with the suitable mechanism 7, such as an eccentric mechanism or a crankshaft mechanism 7. In a manner which is known per se, this mechanism 7 is arranged so as to be capable of setting the length of stroke of the rod, by means of which the suction and pressure capacity of the pump 1 can be influenced. The mechanism 7 is connected, in practice, with a rotating driving motor, not shown.

The pump 1 may be an autonomous pump, for example for drawing and pumping out a medium or a mixture of mediums which may or may not contain air. Said mixture may be water containing water vapor or air, but it may also be air containing water and/or water vapor. The pump 1 may also be used as a vacuum pump or, for example, it may be connected with a non-self-starting pump, such as a centrifugal pump, to draw water to the eye of such a pump, as a result of which this combination can readily start by itself.

The pump 1 itself is insensitive to contamination in the medium, allowing it to transfer even dirty water, such as waste water, sewage water or groundwater, whether or not in alternation with medium originating from surface water or well-point de-watering.

The invention claimed is:

1. A pump comprising:

a suction space at least partly bounded by a flexible body and two end elements, first end element configured so as to move in a reciprocating manner and a second end element configured to be non reciprocating, the first end element and the second end element each contacting the flexible body so as to compress the flexible body therebetween when the first end element and the second end element approach one another, a delivery space surrounding the suction space and around which a housing is provided, and valves provided in the housing and in at least one of the end elements, the valves being constructed such that when a volume of the suction space is increased, a medium is sucked into said suction space, and when the volume is reduced, the medium flows through one of the valves to the delivery space, from which it is expelled when a volume of the delivery space is reduced, the flexible body has inner edges which contact the first end element and the second end element at circumferential edges of the end elements; wherein:

when the first end element and the second end element approach one another and the volume of the suction space is minimal, the flexible body inner edges approach each other and the flexible body is flexed to a folded-up state; and when the first end element and the second end element are a maximum distance apart, the inner edges are at a distance from each other and the flexible body is in an unfolded state.

2. The pump according to claim 1, wherein the suction space is a cylindrical space, of which at least part of the circumference is formed by the flexible body.

3. The pump according to claim 1, wherein the flexible body is a tyre which is completely located inside the delivery space and which has two joined sides ending in two inner edges which contact the first end element and the second end element at the circumferential edges of the end elements, and wherein when the inner edges approach one another, the sides are flexed to the folded-up state, and wherein when the first end element and the second end element are at the maximum distanced apart, the sides are flexed to the unfolded state.

4. The pump according to claim 1, wherein at least one of the valves is provided between the suction space and the delivery space in one of the end elements, and which opens and closes in response to excess pressure and reduced pressure in the suction space.

5. The pump according to claim 1, wherein the pump comprises an intake and an outlet for the medium, which are each connected to the suction space and the delivery space, respectively, through one of the valves.

6. The pump according to claim 1, wherein one of the end elements is a fixed end element formed by part of the housing of the pump.

7. The pump according to claim 1, wherein the end elements are flat end plates.

8. The pump according to claim 1, wherein the pump comprises a rod which is connected to the first end element and configured to move in a reciprocating manner.

9. The pump according to claim 8, wherein the pump comprises an eccentric or a crankshaft; which is connected to the rod and by which a stroke of the rod is set.

10. The pump according to claim 1, wherein the valves are automatically operating valves.

11. The pump of claim 1, wherein the flexible body inner edges have sides therebetween, and the sides flex between the folded-up state and the unfolded state when the first end element and the second end element move toward and away from each other, respectively.

12. A method of pumping wherein, inside a pump, by reciprocating a flexible body which is subjected to flexural strain thereby, the pump having a suction space at least partly bounded by the flexible body, a first end element and a second end element, the method comprises:

during a first phase, a volume of the suction space is reduced causing a medium contained therein to be forced into a delivery space which surrounds the suction space; and during a second phase, which is after the first phase, when expansion of the suction space takes place, and a reduced pressure is formed in the suction space and, at a same time, an excess pressure is formed in the delivery space, causing the medium to be expelled from the deliver space, wherein the flexible body has inner edges which contact the first end element and the second end element at circumferential edges of the end elements, the delivery space surrounds the suction space whereby the flexible body, which during reciprocating is subjected to flexural strain, is completely located inside the delivery space;

when the end elements approach one another and the volume of the suction space is minimal, the flexible body is flexed to a folded-up state; between the end elements and when the end elements are a maximum distance apart, the flexible body is in an unfolded state.

13. The method according to claim 12, wherein the reduced pressure in the suction space during the second phase causes the medium to be drawn into the suction space through an intake, and excess pressure in the suction space during the first phase causes said medium to be forced into the delivery space through the valve.

14. The method according to claim 12, wherein at least one of the end elements is configured so as to move in a reciprocating manner, the delivery space which surrounds the suction space and around which a housing is provided, and valves provided in the housing and in at least one of the end elements, the valves being constructed such that when the volume of the suction space is increased, the medium is sucked into said suction space, and when the volume of the suction space is reduced, the medium flows through one of the valves to the delivery space from which it is expelled when the volume of the delivery space is reduced, the method is used in a vacuum pump which is connected to a non-self-starting pump.

15. The method of claim 12 wherein pumping includes pumping a medium or a mixture of mediums, which may or may not contain air, or in a process of pumping water or water vapor which may or may not contain air, or in a process of pumping air which may or may not contain water and/or water vapor.

16. The method of claim 12 wherein the method is used in a vacuum pump, wherein the medium is air, which may or may not contain dirty water, waste water, sewage water or groundwater, or which comprises surface water or water obtained from well-point de-watering.

* * * * *